United States Patent [19]

Baldwin

[11] Patent Number: 4,624,275

[45] Date of Patent: Nov. 25, 1986

[54] EMERGENCY UMBRELLA WITH HEAD MOUNTABLE TO HANDLE'S OTHER END

[76] Inventor: Blair F. Baldwin, 309 E. 87th St., New York, N.Y. 10128

[21] Appl. No.: 750,549

[22] Filed: Jul. 1, 1985

[51] Int. Cl.[4] ..... A45B 13/00; A45B 19/00; A45B 25/20

[52] U.S. Cl. ..... 135/19.5; 135/25 R; 135/33 R

[58] Field of Search ..... 135/16, 18, 19.5, 25, 135/33 R, 20 R, 33 C, 34

[56] References Cited

U.S. PATENT DOCUMENTS

| | | | |
|---|---|---|---|
| 1,345,067 | 6/1920 | Brown | 135/19.5 |
| 1,858,960 | 5/1932 | Krüger | 135/20 R |
| 2,044,805 | 6/1936 | Meyerkort | 135/20 R |
| 2,051,750 | 8/1936 | Siers | 135/33 R |
| 2,091,676 | 8/1937 | Fliegner | 135/25 R |
| 2,439,752 | 4/1948 | Pfeil | 135/19.5 |
| 2,700,390 | 1/1955 | Poston et al. | 135/20 R |
| 3,177,883 | 4/1965 | Militano | 135/19.5 X |
| 3,186,421 | 6/1965 | Wilson | 135/20 R |
| 4,084,600 | 4/1978 | de Polo | 135/20 R |
| 4,456,023 | 6/1984 | Fujihashi | 135/25 R |

FOREIGN PATENT DOCUMENTS

| | | | |
|---|---|---|---|
| 1429394 | 8/1966 | France | 135/19.5 |
| 9087 | of 1895 | United Kingdom | 135/18 |

*Primary Examiner*—Robert A. Hafer

*Assistant Examiner*—D. Neal Muir

*Attorney, Agent, or Firm*—Burgess, Ryan and Wayne

[57] ABSTRACT

An umbrella includes a hollow tubular handle having an open end and an opposite closed end with an umbrella mounting aperture; a hub having a central section connected between an enlarged flange section with a dimension greater than the opening in the first end, and a cylindrical, reduced diameter shaft insertable within the umbrella mounting aperture; four ribs hingedly secured to the hub by living hinges to permit pivotal movement of the ribs only between an opened position in which the ribs are substantially positioned in a plane perpendicular to the shaft and a closed position in which the ribs are substantially coaxial with and adjacent to the shaft, the central section providing a limit on the pivotal movement of the ribs to prevent inversion thereof; a web of flexible, water-resistant material connected to the hub and the ribs; a key secured to the shaft; four key receiving slots in communication with the umbrella mounting aperture for matingly engaging with the key to permit locking of the hub to the handle when the shaft is inserted and rotated within the umbrella mounting aperture, whereby the closed end of the handle biases the ribs to the opened position; and the hub, ribs and web being insertable into the handle through the open end thereof so as to fit entirely within the handle with only the enlarged end of the hub protruding therefrom.

10 Claims, 9 Drawing Figures

EMERGENCY UMBRELLA WITH HEAD MOUNTABLE TO HANDLE'S OTHER END

BACKGROUND OF THE INVENTION

This invention relates generally to umbrellas and, more particularly, is directed to an emergency umbrella in which the handle also functions as a carrying case.

Because of unpredictability in the weather, it would be desirable to always have an umbrella ready at hand in case of an emergency. However, the size and bulkiness of conventional umbrellas does not make this feasible. Although there are presently on the market conventional umbrellas sold, for example, under the trademark "Totes" which are compact and fit within a briefcase, such umbrellas are rather complex in construction and therefore expensive.

Disposable type umbrellas of the type in which the handle also functions as a carrying case are disclosed, for example, in U.S. Pat. Nos. 2,700,390 and 4,084,600. U.S. Pat. No. 2,700,390 discloses a disposable umbrella in which the handle is detachable from the main portion of the umbrella and serves as a carrying case therefor. With this umbrella, the struts or ribs are normally pivoted in a direction opposite that from a normally closing umbrella, that is, in a direction inverted from a conventional umbrella. Accordingly, there is the necessity of utilizing cords to tie down the struts to prevent the umbrella from inverting.

U.S. Pat. No. 4,084,600 discloses an umbrella similar to that of U.S. Pat. No. 2,700,390 in which the struts or ribs are pivotally secured to a hub which slides within the handle. In this patent, the struts or ribs are pivotally attached to the hub for pivotal movement to a completely inverted position when it is carried within the handle. With this umbrella, the struts or ribs are maintained in an opened position by biasing a locking plate which biases the the inner ends of the struts. However, this umbrella is of a relatively complicated construction.

U.S. Pat. No. 2,439,752 also discloses an umbrella in which the umbrella portion is insertable within a handle. The umbrella portion is locked in place at the upper end of the handle by a coupling or fastening pin which passes through openings on opposite sides of the upper part of the tubular handle. However, to close the umbrella, the ribs are not pivotable downwardly in this umbrella, but only laterally in the plane of the umbrella in its opened position.

U.S. Pat. No. 2,044,805 discloses an umbrella in which ribs secured to the fabric are effectively pivotally mounted with respect to a circular disc, although not secured to the circular disc. The stick or handle is secured at its upper end to the circular disc. A runner is adapted to slide on the handle and includes a keying element associated with the upper end of the handle. Thus, when the runner is slid along the handle into contact with the umbrella portion, the runner pivotally biases the ribs outwardly into their opened position. Thereafter, the runner is turned and locked in place at the upper end of the handle, to lock the umbrella in its opened position. With this umbrella, however, the handle is fixedly secured to the circular disc and does not also function as a carrying case for the umbrella.

U.S. Pat. No. 2,994,333, although not disclosing any pivoting struts or ribs, discloses a cord connected to the outer ends of the struts and which is contained also within a folded hem of the canopy at the outer periphery of the umbrella.

OBJECTS AND SUMMARY OF THE INVENTION

Accordingly, it is an object of the present invention to provide a disposable umbrella which can be used in emergency situations.

It is another object of the present invention to provide an umbrella in which the handle also functions as a carrying case for the umbrella.

It is still another object of the present invention to provide an umbrella having a novel locking mechanism for locking the umbrella in its opened position.

It is yet another object of the present invention to provide an umbrella in which the struts or ribs cannot be inverted.

It is a further object of the present invention to provide an umbrella which is relatively easy and economical to manufacture and use.

In accordance with an aspect of the present invention, an umbrella includes a hollow tubular handle having a first end formed with an opening and a second, opposite closed end having an umbrella mounting aperture therein; a hub having an enlarged end with a lateral dimension greater than the umbrella mounting aperture, and a generally cylindrical shaft extending from the elongated end and insertable within the umbrella mounting aperture; a plurality of ribs, each having a web support end and an opposite, hub mounting end hingedly secured to the hub to provide pivotal movement of each respective rib only between an opened position in which the ribs are substantially positioned in a plane perpendicular to the shaft and a closed position in which the ribs are substantially coaxial with and adjacent to the shaft; a web of flexible, water resistant material connected to the hub and the web support ends of the ribs; key means associated with one of the hub and the umbrella mounting aperture; key receiving means associated with the other of the hub and the umbrella mounting aperture for matingly engaging with the key means to permit locking of the hub to the handle when the shaft is inserted and rotated within the umbrella mounting aperture, whereby the closed end of the handle biases the ribs to the opened position; and the hub, ribs and web being so dimensioned that when the ribs are in the closed position, the hub, ribs and web can be inserted into the handle through the opening in the first end so as to fit entirely within the handle with only the enlarged end of the hub protruding therefrom.

The above, and other, objects, features and advantages of the present invention will become readily apparent from the following detailed description thereof which is to be read in connection with the accompanying drawings.

DETAILED DESCRIPTION OF THE PREFERRED EMBODIMENTS

Figure 1:
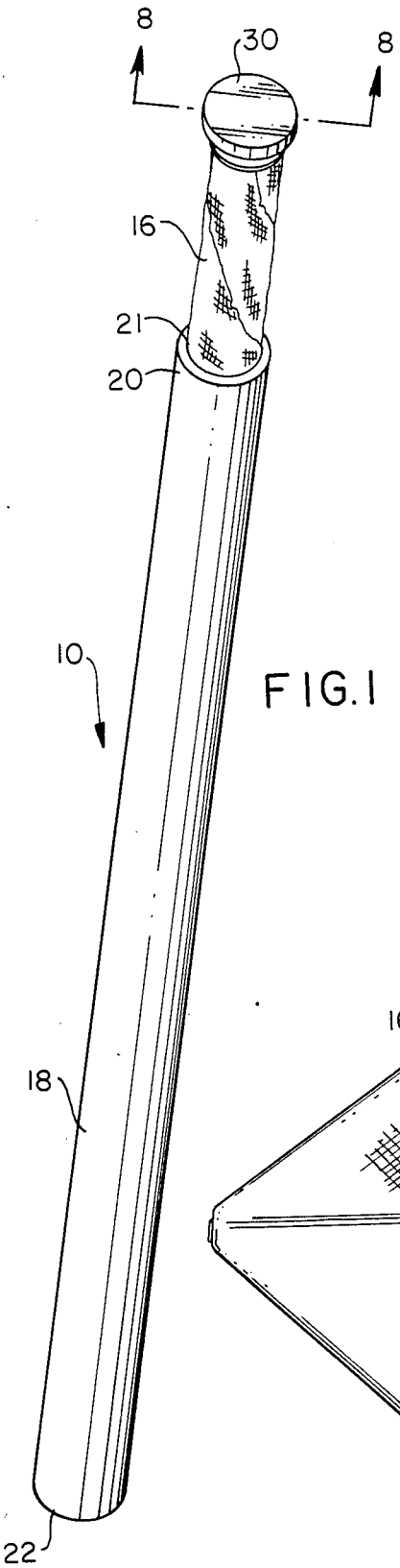
FIG. 1 is a perspective view of an umbrella according to one embodiment of the present invention, with the umbrella portion partially inserted within the handle.
Figure 2:
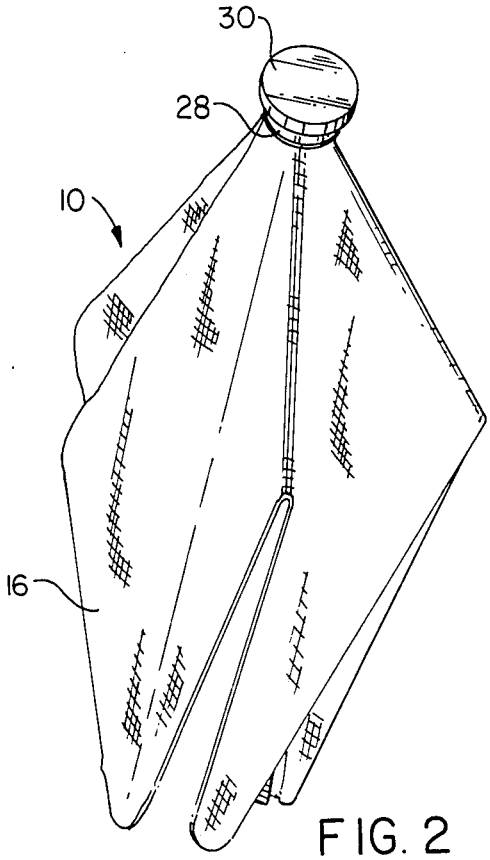
FIG. 2 is a perspective view of the umbrella portion of FIG. 1 in a partially opened position.
Figure 3:
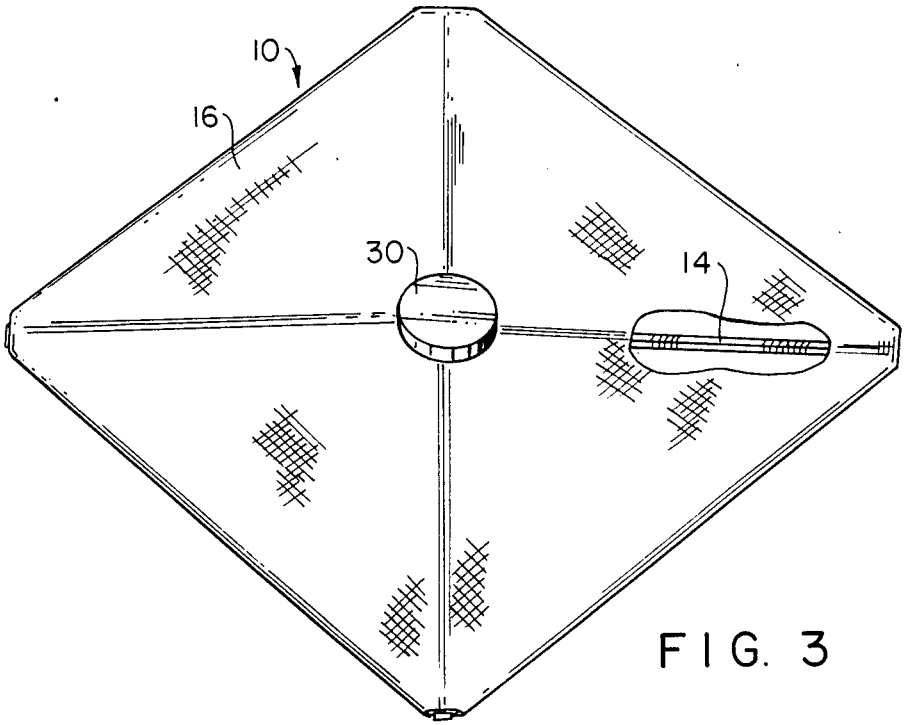
FIG. 3 is a perspective view, looking from the top, and partially broken away, of the umbrella portion of FIG. 1 in its opened position.

Referring to the drawings in detail, an umbrella 10 according to the present invention generally includes a hub 12, a plurality of struts or ribs 14 hingedly connected to hub 12 and extending outwardly therefrom, a fabric or web of flexible water resistant material 16 connected to hub 12 and ribs 14 and which provides the canopy or cover for umbrella 10, and a hollow tubular handle 18 which also functions as a carrying case for the umbrella.

Figure 4:
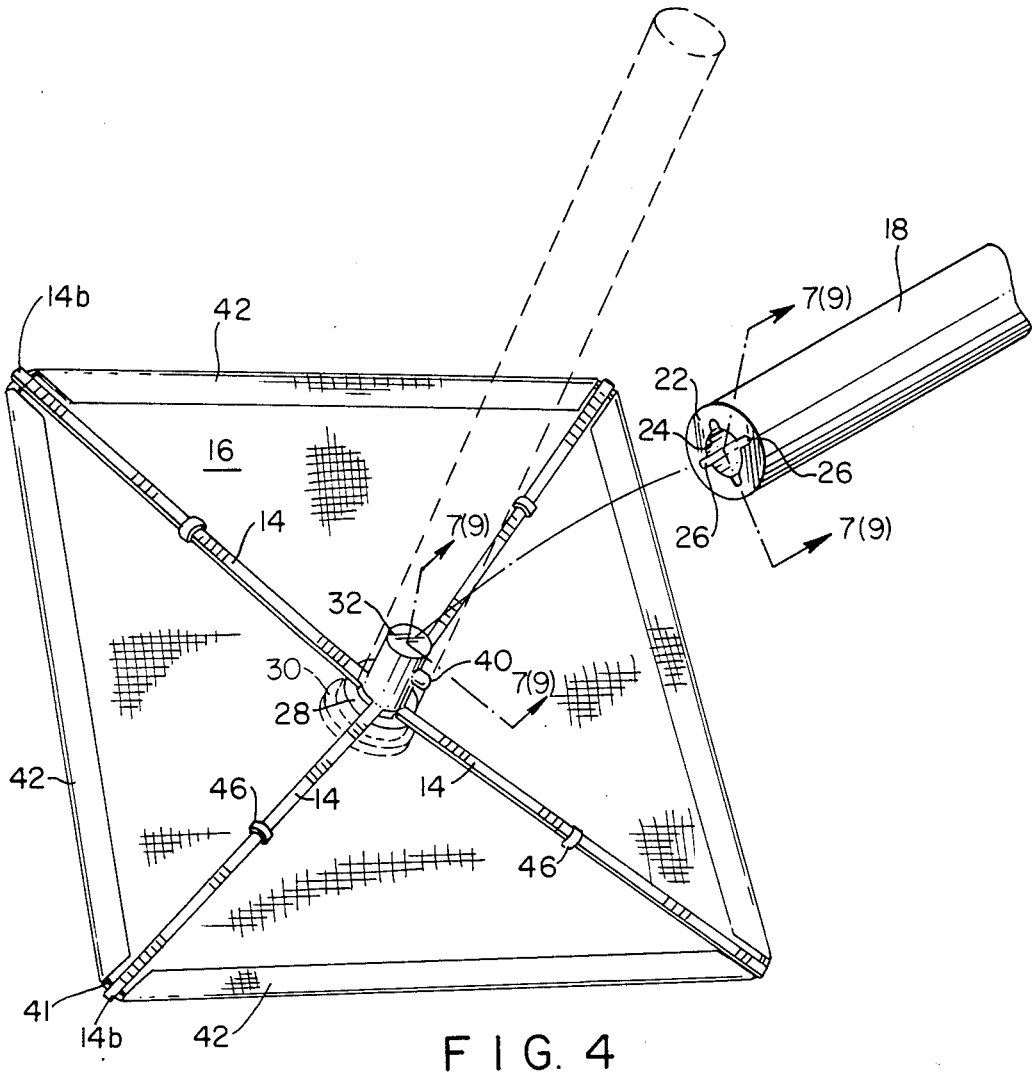
FIG. 4 is a perspective view of the umbrella portion of FIG. 1, looking from the bottom, in its opened position, and being secured to the handle.

Specifically, as shown in FIG. 1, handle 18 includes a first end 20 formed with an opening 21 and a second, opposite closed end 22 having an umbrella mounting aperture 24 centrally formed therein. As shown in FIG. 4, closed end 22 also includes a plurality of key receiving slots 26 extending radially outward from and in communication with umbrella mounting aperature 24. Although four key receiving slots 26 are shown, it will be appreciated from the description hereinafter that only one key receiving slot 26 need be provided, or a different number of key receiving slots 26 can be used.

Figure 5:
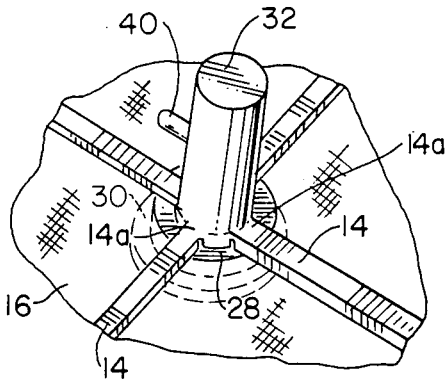
FIG. 5 is a blown-up perspective view of the hub of FIG. 4.
Figure 6:
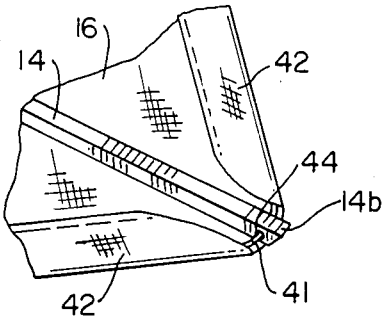
FIG. 6 is a blown-up perspective view of one corner of the umbrella portion of FIG. 4.

Referring now to FIGS. 5 and 6, hub 12 is formed with a solid, cylindrical central section 28 having a diameter less than the inside diameter of handle 18, whereby it can fit within open end 20 of handle 18, and greater than umbrella mounting aperture 24. An enlarged flange section 30 is integrally formed at one end of central section 28 and has a diameter greater than that of the opening formed in first end 20. In this manner, when central section 28 is positioned within first open end 20, enlarged flange section 30 abuts against the outer edge of handle 18 thereat.

Hub 12 is also formed with a cylindrical, reduced diameter shaft 32 integrally formed with central section 28 at the opposite end thereof. Reduced diameter shaft 32 is formed with a diameter less than that to central section 28.

Figure 7:
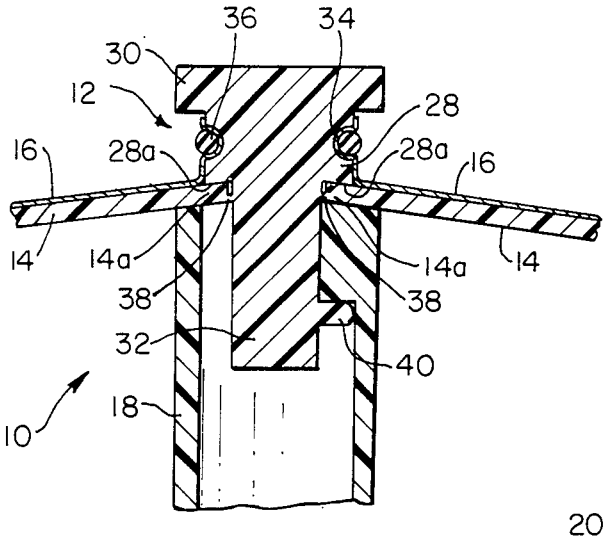
FIG. 7 is a cross-sectional view of the umbrella of FIG. 4 taken along line 7—7 thereof in assembled condition.
Figure 9:
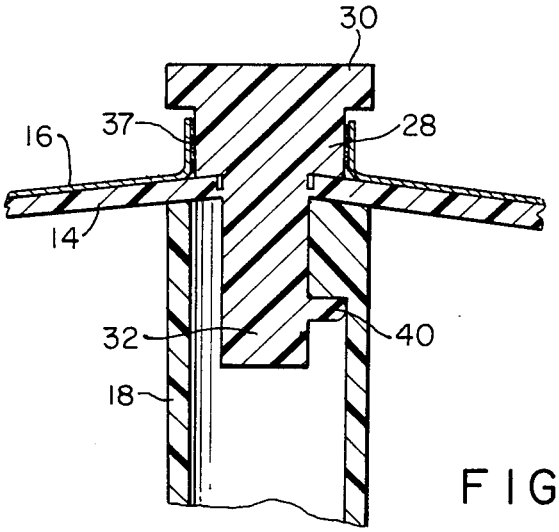
FIG. 9 is a cross-sectional view of the umbrella of FIG. 4, as modified in accordance with a second embodiment of the invention, taken along line 9—9 thereof in assembled condition.

For securing web 16 to hub 12, central section 28 may also be formed with a circular groove 34 for holding an O-ring 36, which secures web 16 to hub 12 in a fluid tight arrangement, as shown in FIG. 7. In addition, O-ring 36 may extend sligtly out of groove 34. If O-ring 36 is made of a flexible, resilient material, such as rubber or the like, when hub 12 is inserted within first open end 20, O-ring 36 will provide a seal between central section 28 and the inside wall of handle 18, to prevent water from escaping. It will be appreciated, however, that any other suitable means can be used to secure web 16 to hub 12. For example, as shown in FIG. 9, an adhesive 37 can be used to bond web 16 to central section 28, in place of groove 34 and O-ring 36. Alternatively, web 16 can be heat sealed to central section 28.

Figure 8:
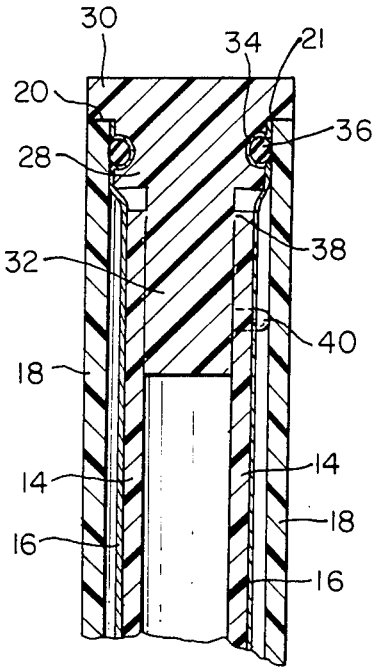
FIG. 8 is a longitudinal cross-sectional view of the umbrella of FIG. 1, when the umbrella is in its fully closed and carrying position, taken along line 8—8 thereof.

As shown in FIGS. 5, 7 and 8, each rib 14 is hingedly secured at a mounting end **14*a* thereof to reduced diameter shaft 32 of hub 12, preferably at the connection of reduced diameter shaft 32 to central section 28. Such pivotal connection may be formed by any suitable means, but preferably is formed by a living hinge 38. Specifically, living hinge 38 permits pivotal movement of each rib 14 to a closed position, as shown in dashed lines in FIG. 8 in which ribs 14 are substantially coaxial with and adjacent to reduced diameter shaft 32. Living hinge 38 also permits pivotal movement of ribs 14 to an opened position of the umbrella in which ribs 14 are substantially positioned in a plane perpendicular to reduced diameter shaft 32. Because ribs 14 are pivotally connected to reduced diameter shaft 32 at the upper end thereof, that is, at the connection of reduced diameter shaft 32 to central section 28, pivotal movement of ribs 14 are limited by central section 28. Preferably, the lower annular surface 28*a* of central section 28 extending about reduced diameter shaft 32 forms an angle of approximately 80° with reduced diameter shaft, as shown in FIG. 7. Thus, when ribs 14 are opened, they are limited to the same angular extent so that web 16 forms an outwardly and slightly downwardly sloping configuration, similar to a conventional umbrella. This angle may be changed, but should not exceed 90°, since otherwise, the rain will collect at the center of the umbrella. In this manner, full inversion of ribs 14, and thereby web 16, is prevented during, for example, high winds. Although only four ribs 14** are shown, any suitable number of ribs may be provided with the present invention.

As shown in FIGS. 4, 5 and 7, a key 40 is secured to and radially extends from reduced diameter shaft 32 below living hinges 38. In this regard, when reduced diameter shaft 32 is inserted within umbrella mounting aperture 24, key 40 is received within one key receiving slot 26. Then, hub 12 and handle 18 are rotated with respect to each other so that key 40 is positioned within handle 18 and behind closed end 22 to lock handle 18 to hub 12. During this operation, closed end 22 abuts against ribs 14 and biases the same outwardly to maintain ribs 14 in the aforementioned opened position. Of course, key 40 could extend radially inwardly from umbrella mounting aperture 24, and key receiving slots or grooves could be formed in shaft 32, all of which is within the scope of the present invention, as claimed. Also, a plurality of keys 40, not greater than the number of slots 26, can be provided.

Web 16 may be secured to ribs 14 by any suitable means. For example, as shown in FIGS. 4 and 6, a cord 41 is secured within a hem 42 of web 16, hem 42 being cut away at the opposite web support ends **14*b* of webs 14. Web support ends 14*b* are formed with through apertures 44 through which cord 41 extends. Notches may be used instead of through apertures 44. Thus, cord 41 connects web support ends 14*b* to hems 42 of web 16 and provides rigidity to the umbrella. Alternatively, cord 41 may be constructed of a material to allow heat sealing thereof to web 16, thereby eliminating the need for hem 42. It will be appreciated, however, that any other suitable means may be provided, for example, use of an adhesive to adhesively secure web support ends 14*b* to the periphery of web 16. In addition, suitable securing means may be provided at the mid-portions of ribs 14, for example, by means of tabs 46** secured to web 16 and through which ribs 14 extend to provide further support between ribs 14 and web 16.

In operation, to use umbrella 10, shaft 32 is inserted within umbrella mounting aperature 24, with key 40 being received within one of key receiving slots 26. At this time, closed end 22 abuts against and biases ribs 14 to the opened position. Turning of handle 18 with respect to hub 12 results in key 40 being positioned behind the closed end 22 within handle 18 to lock hub 12 to handle 18 and to maintain ribs 14 in their opened position, as shown in FIG. 4. As a result, because web 16 is secured to ribs 14, the umbrella is opened and operational.

To close and store the umbrella, hub 12 is rotated with respect to handle 18 so that key 40 is positioned in alignment with a key receiving slot 26. Reduced diameter shaft 32 is then removed from umbrella mounting aperture 24. Ribs 14 are then pivoted to their closed position, as shown in FIG. 8, in which ribs 14 are substantially coaxial with and adjacent to reduced diameter shaft 32. Web 16 is then tightly wrapped about ribs 14, and ribs 14 and the tightly wrapped web 16 are inserted within open end 20 of handle 18, web support ends 14*b* being inserted first. The assembly of hub 12, ribs 14 and webs 16 are inserted within handle 18 until enlarged flange section 30 abuts against the outer face of first end 20 of handle 18. Because O-rings 36 are provided, a sealing effect is achieved at open end 20. Thus, if the umbrella is thereafter carried with open end 20 in its down position, no leakage of water will occur.

Having described specific prefered embodiments of the present invention with reference to the accompanying drawings, it is to be appreciated that the present invention is not limited to those precise embodiments, and that various changes and modifications may be effected therein by one of ordinary skill in the art without departing from the spirit or scope of the present invention as defined by the appended claims.

What is claimed is:

1. An umbrella comprising:

a hollow tubular handle including a first end formed with an opening and a second, opposite closed end having an umbrella mounting aperture therein;

a hub having an enlarged end with a lateral dimension greater than said umbrella mounting aperture, and a generally cylindrical shaft extending from said enlarged end and insertable within said umbrella mounting aperture;

a plurality of ribs, each having a web support end and an opposite hub mounting end hingedly secured to said hub to provide pivotal movement of each said rib only between an opened position in which said ribs are positioned substantially perpendicular to said shaft and a closed position in which said ribs are substantially coaxial with and adjacent to said shaft;

a web of flexible, water resistant material connected to said hub and said web support ends of said ribs, key means associated with one of said hub and said umbrella mounting aperture;

key receiving means associated with the other of said hub and said umbrella mounting aperture for matingly engaging with said key means to permit locking of said hub to said handle when said shaft is inserted and rotated within said umbrella mounting aperture, whereby the closed end of said handle biases said ribs to said opened position; and said hub, ribs and web being so dimensioned that when said ribs are in said closed position, said hub, ribs and web can be inserted into said handle through the opening in the first end so as to fit entirely within said handle with only said enlarged end of said hub protruding therefrom.

2. An umbrella comprising:

a hollow tubular handle including a first end formed with an opening and a second, opposite closed end having an umbrella mounting aperture therein;

a hub having an enlarged end with a lateral dimension greater than said umbrella mounting aperture, and a generally cylindrical shaft extending from said enlarged end and insertable within said umbrella mounting aperture and a central section connected between said enlarged end and said shaft, said central section being dimensioned to fit within the opening in the first end of the handle, and having a lateral dimension greater than said umbrella mounting aperture;

a plurality of ribs, each having a web support end and an opposite hub mounting end hingedly secured to said hub to provide pivotal movement of each said rib only between an opened position in which said ribs are positioned substantially perpendicular to said shaft and a closed position in which said ribs are substantially coaxial with and adjacent to said shaft;

a web of flexible, water resistant material connected to said hub and said web support ends of said ribs;

key means associated with one of said hub and said umbrella mounting aperture;

key receiving means associated with the other of said hub and said umbrella mounting aperture for matingly engaging with said key means to permit locking of said hub to said handle when said shaft is inserted and rotated within said umbrella mounting aperture, whereby the closed end of said handle biases said ribs to said opened position; and said hub, ribs and web being so dimensioned that when said ribs are in said closed position, said hub, ribs and web can be inserted into said handle through the opening in the first end so as to fit entirely within said handle with only said enlarged end of said hub protruding therefrom.

3. An umbrella according to claim 2, wherein said web is secured to said central section.

4. An umbrella according to claim 3, wherein said central section includes a circular groove; and further comprising a resilient O-ring positioned within said circular groove for securing said web to said central section thereat.

5. An umbrella according to claim 2, wherein said web is secured to said central section by an adhesive.

6. An umbrella according to claim 2, wherein said web is secured to said central section by a heat seal.

7. An umbrella according to claim 2, wherein said ribs are hingedly secured to said shaft near the connection of said shaft to said central section, and said central section limits rotation of each of said ribs to an angle of not more than approximately 90° with respect to said shaft.

8. An umbrella according to claim 1, wherein said key receiving means includes at least one key receiving slot extending radially from and in communication with said umbrella mounting aperture in said second closed end, and said key means includes a key secured to said shaft and dimensioned to fit within each key receiving slot to permit locking of said hub to said handle when said shaft is inserted within said umbrella mounting aperture and rotated with respect thereto.

9. An umbrella according to claim 1, wherein said web support ends of said ribs are each formed with a through aperture; and further comprising cord means extending through said through apertures for interconnecting said web support ends of said ribs.

10. An umbrella according to claim 9, wherein said web includes a hem formed at its periphery which encloses said cord means.

* * * * *